United States Patent [19]

Knapp, Jr. et al.

[11] Patent Number: 4,910,490

[45] Date of Patent: Mar. 20, 1990

[54] END TERMINAL SEAL FOR AN ELECTRIC FUSE

[75] Inventors: Edward J. Knapp, Jr., Stratham, N.H.; Richard J. Perreault, Amesbury, Mass.

[73] Assignee: Gould, Inc., Rolling Meadows, Ill.

[21] Appl. No.: 372,984

[22] Filed: Jun. 28, 1989

[51] Int. Cl.[4] ..... H01H 85/14

[52] U.S. Cl. ..... 337/248; 337/251

[58] Field of Search ..... 337/251, 252, 253, 248, 337/205; 29/623

[56] References Cited

U.S. PATENT DOCUMENTS

| | | | |
|---|---|---|---|
| 2,639,350 | 5/1953 | Cox . | |
| 2,837,614 | 6/1958 | Fister . | |
| 3,250,879 | 5/1966 | Jacobs, Jr. . | |
| 4,044,326 | 8/1977 | Rodrigues | 337/248 |

*Primary Examiner*—H. Broome

*Attorney, Agent, or Firm*—Fish & Richardson

[57] ABSTRACT

An electric fuse of the type which has a tubular fuse casing and a solid fuse end terminal telescopically received within the fuse casing is provided with an annular seal which is contained within an annular groove formed in the outer lateral wall of the end terminal. The seal is formed from a settable material which has been injected into the groove through a seal injection opening in the outer end of the end terminal which extends from the axial outer end and into fluid communication with an annular groove provided in the end terminal. A seal material bleed opening is provided in the end terminal which also extends from the axial outer end of the end terminal and into fluid communication with the annular groove. The bleed opening is positioned substantially diametrically opposed to the seal injection opening.

7 Claims, 2 Drawing Sheets

END TERMINAL SEAL FOR AN ELECTRIC FUSE

BACKGROUND OF THE INVENTION

1. Field of the Invention

This invention relates to electric fuses. More particularly it relates to means for establishing a seal between a metal terminal plug and the tubular electric fuse casing into which the plug is inserted.

2. Description of the Prior Art

It has for a long time been recognized that it is desirable for an electric fuse to be designed such that the fuse casing and end terminals cooperate with one another to prevent the loss of the pulverulent arc-quenching filler contained within the fuse casing, and, to prevent the escape of products of arcing when the fuse "blows" in response to overcurrent conditions. In fuses where the casings are closed by large metal plugs, having a relatively large heat absorbing capacity, the problem the fuse designe faces is how to prvent the escape of such products of arcing and the arc-quenching filler through the fine annular gap formed between the outer peripheral surface of the plug and the inner surface of the fuse casing.

One approach to solving this problem is to maintain close tolerances between the plugs and the inner surface of the fuse casing. Maintaining sufficiently close tolerances to solve this problem would substantially increase the cost of production of such a fuse. If the tolerances of the plugs and casing were set so the define a tight fit into the casing, considerable undesirable stresses could be set up in the casing materials. A number of approaches are known in the prior art for sealing electric fuses whose casings are closed by a pair of metal terminal plugs. These approaches include the use of annular seals, such as o-rings, and the use of annular seals formed from a settable sealing material injected into annular grooves provided in the terminal plugs through communicating with the grooves formed in the sidewalls of the tube casings.

Other known approaches have been to "butter" on the outside of the terminal plug, a sealing material such as RTV silicone rubber adhesive sealant. Another approach has been use of an epoxy material to jacket the ends to attempt to effect the seal.

U.S. Pat. No. 2,639,350, Electric Fuse, shows an electric fuse having a terminal cap of the "ferrule type" which fits over the outside of the ends of the tubular casing. The fuse tube itself is provided with one or more annular grooves and yieldable sealing rings are located in the annular grooves to effect a seal.

U.S. Pat. No. 2,837,614, Protectors for Electric Circuits, discloses an electric fuse having annular grooves in the plug terminals of the fuse, and, provides o-ring in those grooves. This patent also notes that a smooth finish on the inner surface of the casing of the fuse is desirable to obtain a good seal.

U.S. Pat. No. 3,250,879, Electric Fuse Comprising Plug Terminals Having an Improved Seal and Pinning Means, discloses an electric fuse having a plug-type terminal having a plurality of annular grooves therein for forming a seal with the fuse casing. An appropriate sealing medium is introduced through an opening in the fuse casing sidewall which fills the annular grooves to effect a seal. The seal material also extends into the openings in the lateral side walls of the fuse casing to effect a "pinning" of the plug terminal to the fuse casing.

U.S. Pat. No. 4,044,326, Hermetic Seal between Telescoping Cylinders of a Fuse Housing, discloses a seal arrangement for a plug type terminal which is a achieved by a combination of a resilient gasket member and a settable adhesive filling an annular space between the resilient gasket member and a second gasket member or a structural flange or the like.

In the real world of fuse manufacture it has been found that the inner lateral surface of the ends of a fuse casing commonly contain a number of irregularities which have been found to make o-ring seals not capable of effecting a consistently reliable seal between the plug terminal and the fuse casing. Various other techniques of injecting settable adhesives, sealants and epoxy have been found to be time consuming, require long cure times, and to be messy with the injected material often times finding it way into the interior of the fuse and or squirting out the outer end of the fuse. Further, injection techniques wherein the injection is carried out through openings formed in a lateral surface of the fuse casing require comprise of the structural integrity of the casing and lead to a potential vent path for the high pressure products of arcing from the fuse casing, if the seal is not perfectly established.

The object of the present invention is to provide an effective, low cost, clean and fast arrangement for establishing a reliable, high integrity seal between an end terminal block and the interior of the fuse tube of an electric fuse into which the block is received.

It is another object of the present invention to provide such a seal wherein the parts may be handled immediately after injection of the seal and wherein the injection technique does not aloow objectionable quantities of the injected sealant material to pass into the interior of the fuse casing nor out the axial outer end of the fuse casing.

Other objects and advantages of the present invention will become apparent from an examination of the drawing and the accompanying description.

SUMMARY OF THE INVENTION

According to the present invention an improved sealing arrangement is provided for an electric fuse of the type which has a tubular fuse casing and a fuse end terminal telescopically received within the fuse casing. The fuse has an annular seal between the fuse casing and the end terminal which is contained within an annular groove formed in the end terminal. The seal is formed from a settable material which has been injected into the groove. According to the present invention such an electric fuse is provided with a seal injection opening in the end terminal which extends from the axial outer end of the end terminal and into fluid communication with the annular groove provided in the end terminal. A seal material bleed opening is provided in the end terminal which also extends from the axial outer end of the end terminal and into fluid communication with the annular groove. The bleed opening is positioned substantially diametrically opposed to the injection opening.

BRIEF DESCRIPTION OF THE DRAWINGS

The novel features that are considered characteristic of the invention are set forth with particularly in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts and wherein:

DESCRIPTION OF THE PREFERRED EMBODIMENT

Figure 1:
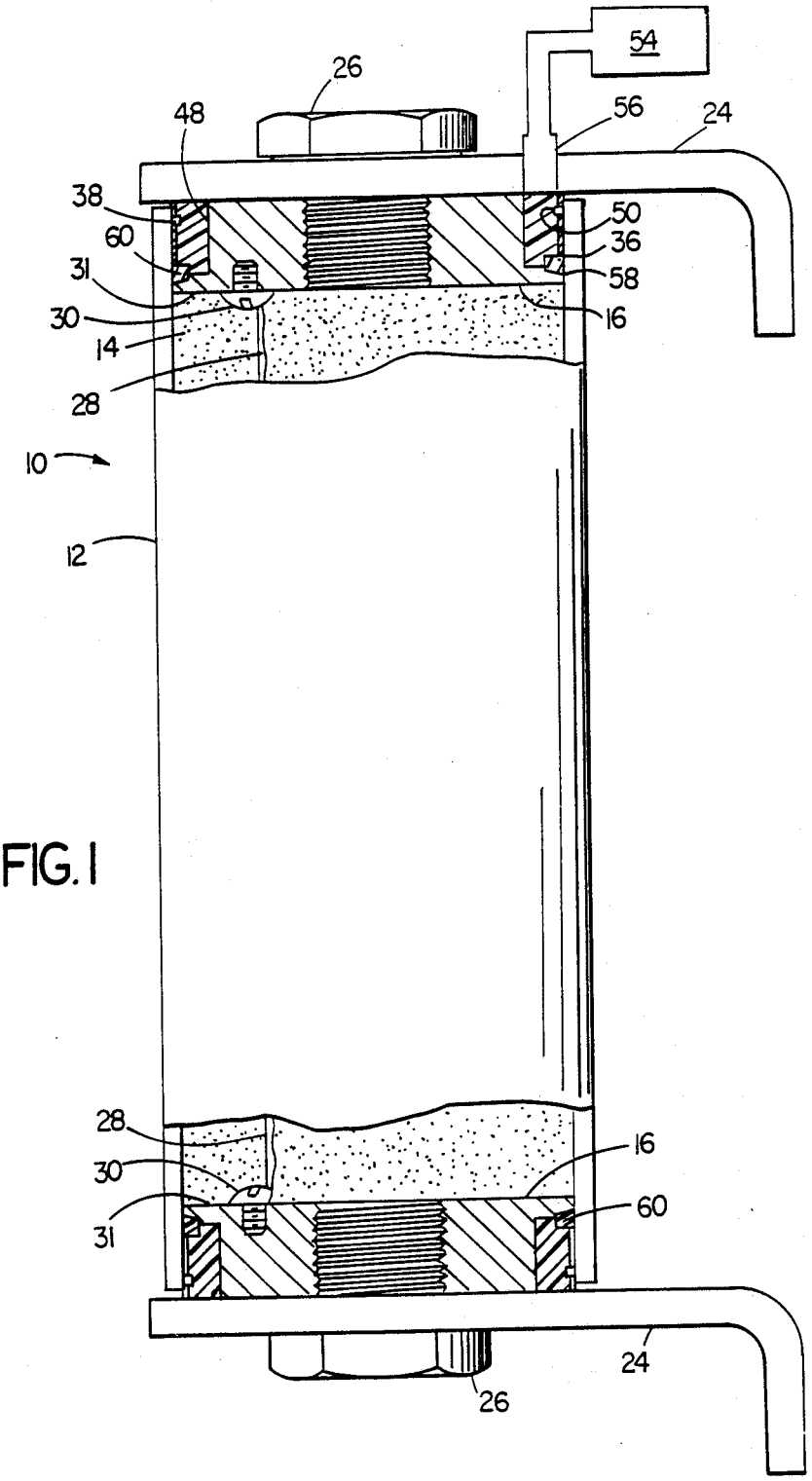
FIG. 1 is a partially sectioned side view of a fuse in accordance with the preferred embodiment of the invention showing a metal terminal plug sealed to a tublar electric fuse casing.

Referring now to the drawing figures reference numberal 10 has been applied to indicate an electric current-limiting fuse embodying the present invention. The fuse 10 is encased in a tbular casing 12 capable of resisting high internal pressures and is made from an electric insulating material such as, for instance, a synthetic resin glass-cloth laminate. The laminate, in a preferred embodiment, may be a melamine glass-cloth laminate. The casing or fuse tube 12 is filled with a granular arc-quenching filler material 14, preferably quarts sand. A pair of plug like end terminals, made from silver plated brass, 16, which will be described in more detail hereinbelow, close the ends of the casing 12. A plurality of steel pins 18 project through openings 20 in the casing 12 and into axially aligned openings 22 in the end terminals 16 to structurally interconnect the end terminals 16 and the casing 12. Angular mounting brackets 24, made from silver plated copper, are fixed by means of hex screws 26 to the axial outer surfaces of the terminal plugs 16.

In the embodiment illustrated, the fuse casing 12 houses a single longitundinally extending scalloped fusible element 28. The fusible element is typically made from a low resistance material such as copper or silver. The ends of the fusible element are electrically conductively attached to the inner surfaces 31 of the end terminals by silver plated brass screws 30 threaded into mating openings in the end terminals. In order to assure that the interconnection between the fusible element, the screws 30, and the end terminals does not loosen during the life of the fuse, and thus, continues to provide a low resistance current path, the connection is heated and a suitable solder 32, is applied to the connection. As pointed out above, the fuse casing 10 is completely filled with a granular arc-quenching filler 14, in which the fusible element is embedded. in the preferred embodiment, the filler material is a 30/40 quartz sand.

Figure 2:
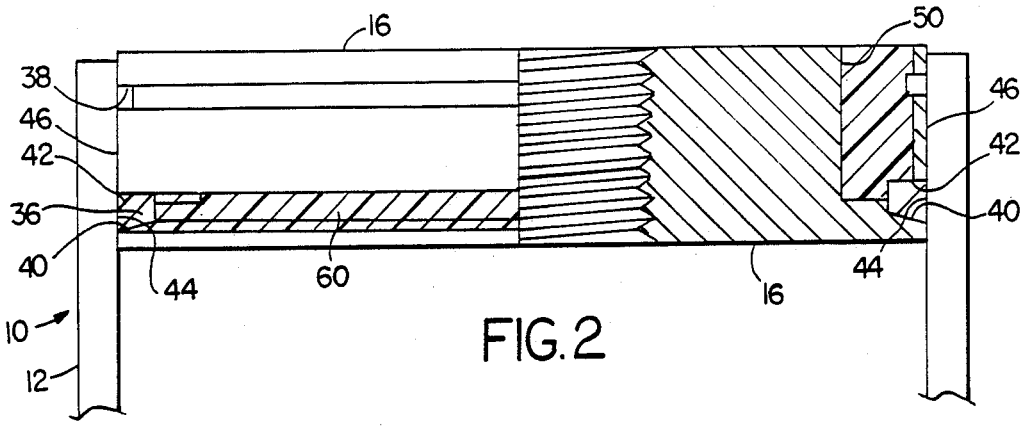
FIG. 2 is an enlarged sectional view of the seal illustrated in FIG. 1. The right hand portion is in section and the left hand side has the tubing removed therefrom.
Figure 3:
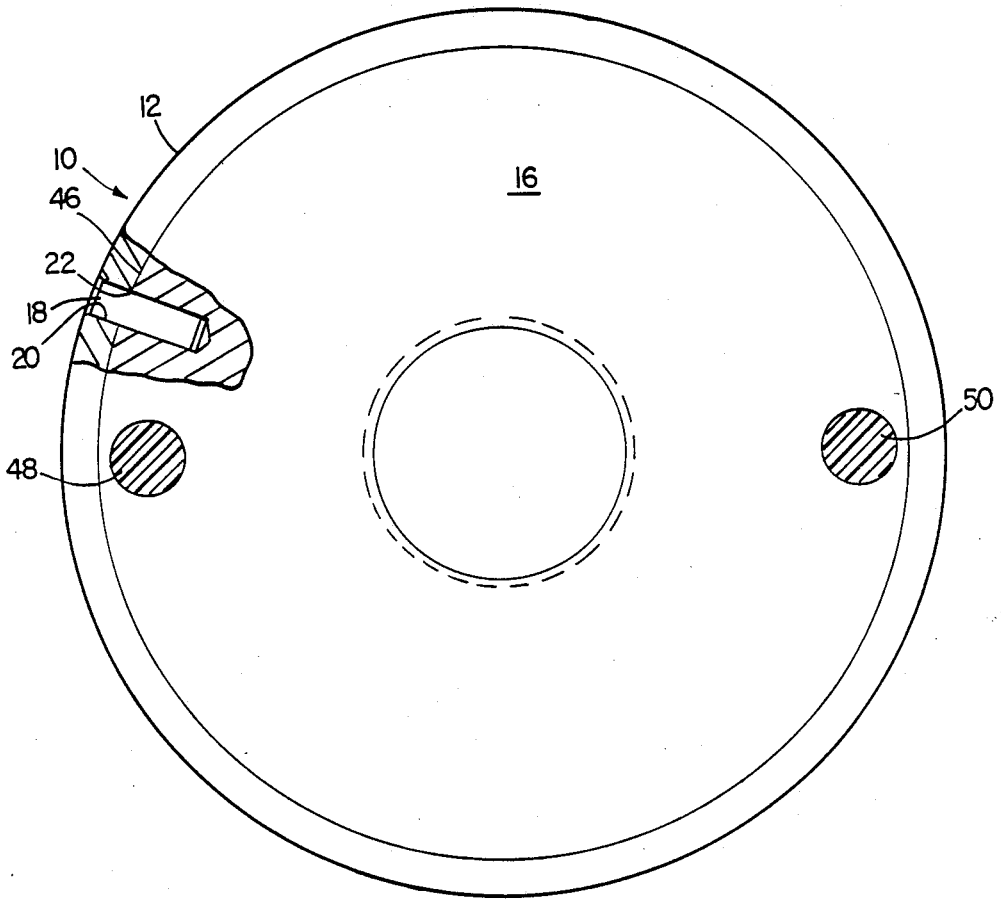
FIG. 3 is a top view of the fuse of FIG. 1 with the mounting strap and hexagonal nut removed therefrom.

Looking now at the end terminal plug 16 in detail it will be seen that each terminal is provided with a first circumferentially extending annular groove 36 which is machined into th lateral wall of the end terminal 16 at a position nearest to the interior of the fuse. A second circumferentially extending annular groove 38, smaller than the first groove 36, is machined in the lateral wall of the end terminal 16 at a location spaced axially from the first groove 36 in the direction toward the outer ends of the end terminals 16. The first annular groove 36 is approximately 0.125 inches wide, at the end terminals outer lateral surface, and tapers inwardly to a narrower width at its maximum depth. The depth of the groove 36 is also 0.125 inches. It will be noted that the inward taper of the groove 36 is accomplished by inclining only the sidewall 40 of the groove which is nearest the axial inward end of the end terminal. The axial outer side wall 42 of the groove 36 defines a 90 degree angle with respect to the lateral outside wall of the end terminal, while the taper of the inclined side wall 40, is 15 degrees from the horizontal, as viewed in FIG. 2. This design configuration allows the maximum seal width of 0.125 inches at the interface with the inner surface 44 of the fuse casing 12. At the same time, this allows the root portion of the lower flange like portion of the end terminal to be sufficiently thick to provide it with the necessary structural rigidity to contain the seal as will be described below. This arrangement, taken with the positioning of the second groove 38, near the outer axial end of the end terminal 16, assures that, the lateral wall portion 46, which lies between the grooves 36 and 38, is of sufficient width and strength to provide the structural integrity necessary to receive the fuse casing attaching pins 18 described above.

As shown in each the drawing figures, a pair of axially extending passageways, 48 and 50, extend from the outer axial end of the end terminals 16 in a direction perpendicular to the grooves 36 and 38. Both of these passageways intersect and thus are in fluid communication with the second annular groove 38, and, both terminate in fluid communication with the first annular groove 36. The passageways 48 and 50 are positioned such that they are diametrically opposed from one another. FIG. 1 shows a schematic representation 52 of the sealant injection apparatus wherein a supply 54 of a settable sealant material, preferably RTV silicone rubber adhesive sealant, has an elongated seal injection nozzle 56 attached thereto which is adapted to be received in the passageway 50, which is designated as the seal injection opening. The lower end 58 of the nozzle 56 is positioned at a location partially extending into the first groove 36 which is designated as the primary seal groove. Upon suitable pressure being applied to the sealant in the reservoir, sealant is injected through the nozzle and into the primary seal groove 36. The sealant material travels from the point of injection around the first annular groove 36 in both directions at substantially the same rate of travel thereby completely filling the groove 36 with sealant when the two semi-circular paths of sealant material meet one another at the other passageway 48, which is designated as the seal material bleed opening. While FIG. 1 shows the seal material being injected into a fuse 10 which is otherwise fully assembled, it should be understood that the seal may be injected at any time during the assembly of the fuse as long as the end terminals have been inserted into and pinned to the fuse casing.

Under "ideal" conditions the tolerances of the outer diameter of the end terminal 16 and the inner surface 44 of the fuse casing would be such that the terminals fit within the casing with virtually no clearance therebetween. under such circumstances the injection of the sealant maternial into the primary seal groove 36 would follow the path described above, and, when the primary seal groove 36 was completely filled with sealant, the sealant would follow the path of least resistance which would be upwardly into the seal bleed passageway 48 heading towards the axial outer end of the end terminal 16. When the operator of the sealant injection apparatus detects the sealant material approaching the axial outer end of the end terminal 16, the pressure upon the sealant in the reservoir would be relieved and the seal 60 would be successfully in place. Under such circumstances the second annular groove 38 would serve no useful purpose.

Under more reliable production conditions the tolerances between the interior surface 44 of the fuse casing 12 and the exterior diameter of the plug-like end terminal 16, will result in a narrow annular space between these components when the metal terminal plugs are installed in the fuse casing and are attached thereto by pinning as described hereinabove. Further, out-of-round conditions or irregularities in the thickness of the fuse casing wall could contribute to irregular spacing between the assembled elements. Under such conditions the injection of the seal into the primary seal groove 36 is carried out in the same manner as described above. Under such conditions, again, as pressure is applied to the sealant in the reservoir, sealant enters the groove 36 and begins to fill the groove through the two semi-circular paths described above. If the sealant enters a location where the clearance between the fuse tube inner wall 44 and outer lateral wall of the terminal plug 16 is large enough the sealant material may begin to flow into that region. It has been found however, that after the sealant flows into such a region for a short distance, the presence of the sealant material within the region itself, and, the friction of the sealant material with the lateral wall of the plug and the inner wall of the fuse casing begins to display sufficient resistance to sealant flow so that the sealant is prevented from flowing any further into this region. At this time, the path of least resistance, again, continues to be the open unfilled portion of the primary seal groove 36 and the sealant continues to flow into this region. Under extreme conditions, ie., a very large space between the terminal plug lateral surface and the inner wall of the fuse casing some quantity of sealant may pass into the interior of the fuse, adjacent the axial inner end of the terminal plug. Such occasional flow of a small amount of sealant into the interior of the fuse has been found to in no way impair the operation of the fuse and in no way creates handling problems with the material therein, as the material is contained within the interior of the fuse.

If the above identified condition, ie., a large clearance, exists at the axial outer end of the terminal plug 16 and fuse casing assembly, any sealant which passes from the primary seal 36, past the portion 46 of the terminal plug 6 which lies between the two grooves, will be received in the outer annual groove 38 thereby totally eliminating the possibility that any sealant material will find its way past the outer groove 38 and to the exterior of the fuse where people assembling and handling the fuses could come in contact with the sealant.

In the illustrated embodiment the sealant material is RTV 103 Black, a silicone rubber adhesive sealant, which is a product of the General Electric Company. It has been found that, for any given sealant material, having a given viscosity, there is a minimum cross sectional area of the channel 36 into which the sealant is to be injected that will allow free flow of the material within the channel. For the RTV 103 material such minimum cross sectional area is 0.135 in which is the cross sectional area of the channel 36 described above.

Accordingly, it should be appreciated that the above described invention provides an effective, low cost, clean and fast arrangement for establishing a reliable, high-integrity seal between an end terminal block and the interior of the fuse casing of an electric fuse into which the block is received. Such seal is established in a manner wherein the parts may be handled immediately after injection of the sealant material and wherein the injection technique allows at most a minimal amount of the injected sealant material to pass into the interior of the fuse casing and no sealant material whatsoever may pass through to the axial outer end of the fuse casing or end terminal.

This invention may be practiced or embodied in still other ways without departing from the spirit or essential character thereof. The preferred embodiment described herein is therefore illustrative and not restrictive, the scope of the invention being indicated by the appended claims and all variations which come within the meaning of the claim are intended to be embraced therein.

What is claimed is:

1. An improved electric fuse of the type having a tubular fuse casing, fuse end terminal telescopically received within the fuse casing, an annular seal between the inner wall of the fuse casing and the end terminal contained within an annular groove formed in the lateral wall of the end terminal, the seal being formed a settable material which has been injected into the groove, wherein the improvement comprises:

a seal injection opening in the end terminal extending from the axial outer end of the end terminal and into fluid communication with the annular groove; and a seal material bleed opening in the end terminal extending from the axial outer end of the end terminal and into fluid communication with the annular groove, said bleed opening being substantially diametrically opposed to said injection opening.

2. The electric fuse of claim 1 wherein the settable material comprises a silicone rubber sealant.

3. The electric fuse of claim 1 wherein the end terminal has a second annular groove formed therein, said second groove being axially spaced from said groove containing said annular seal in a direction closer to the end of the end terminal, said second annular groove being in fluid communication with both said seal injection opening and said seal material bleed opening and, through them, with said seal containing groove.

4. The electric fuse of claim 1 wherein said annular groove and said annular seal contained therein have a maximum width in contact with the inner wall of the fuse casing and a minimum width at the bottom of the annular groove.

5. The electric fuse of claim 3 wherein said second annular groove is smaller in cross section than the annular groove containing the seal.

6. The electric fuse of claim 5 wherein said annular groove and said annular seal contained therein have a maximum width in contact with the inner wall of the fuse casing and a minimum width at the bottom of the annular groove.

7. The electric fuse of claim 1 wherein for a given settable material, having a given viscosity the cross sectional area of the annular groove is the minimum cross section area which will allow free flow of the given settable material therethrough.

* * * * *

UNITED STATES PATENT AND TRADEMARK OFFICE

CERTIFICATE OF CORRECTION

PATENT NO. : 4,910,490

DATED : March 20, 1990

INVENTOR(S) : Edward J. Knapp, Jr. et al.

It is certified that error appears in the above-identified patent and that said Letters Patent are hereby corrected as shown below:

Col. 1, line 21, "designe" should be --designer--.

Col. 1, line 33, "materials" should be --material--.

Col. 1, line 33, insert --Upon insertion of the plugs, such stresses are not acceptable for most casing materials.--

Col. 3, line 22, "tbular" should be --tubular--.

Col. 3, line 54, "in" should be --In--.

Col. 3, line 59, "th" should be --the--.

Col. 4, line 59, "under" should be --Under--.

Signed and Sealed this

Twelfth Day of January, 1993

*Attest:*

DOUGLAS B. COMER

*Attesting Officer*

*Acting Commissioner of Patents and Trademarks*